US005499078A

United States Patent [19]

Kurokawa et al.

[11] Patent Number: 5,499,078

[45] Date of Patent: Mar. 12, 1996

[54] CHARGE ROLLER AND IMAGE FORMING APPARATUS USING THE SAME

[75] Inventors: Junji Kurokawa, Yokohama; Kazuo Nojima, Chiba; Norimasa Sohmiya, Souka, all of Japan

[73] Assignee: Ricoh Company, Ltd., Tokyo, Japan

[21] Appl. No.: 303,744

[22] Filed: Sep. 9, 1994

[30] Foreign Application Priority Data

Sep. 10, 1993 [JP] Japan ..... 5-250039
Jul. 28, 1994 [JP] Japan ..... 6-177333

[51] Int. Cl.[6] ..... G03G 21/00

[52] U.S. Cl. ..... 355/206; 355/207; 355/219; 361/225

[58] Field of Search ..... 355/219, 208, 355/209, 296, 206, 207; 428/466, 906; 361/225, 230

[56] References Cited

U.S. PATENT DOCUMENTS

| | | | |
|---|---|---|---|
| 5,038,174 | 8/1991 | Kato et al. | 355/215 |
| 5,089,851 | 2/1992 | Tanaka et al. | 355/219 |
| 5,253,022 | 10/1993 | Takeuchi et al. | 355/274 |
| 5,363,176 | 11/1994 | Ishihara et al. | 355/219 |
| 5,371,575 | 12/1994 | Sekino et al. | 355/210 |

OTHER PUBLICATIONS

English Abstract of Japanese Kokai 06–266206, Sep. 22, 1994.

English Abstract of Japanese Kokai 05–297681, Nov. 12, 1993.

English Abstract of Japanese Kokai 06–83166, Mar. 25, 1994.

English Abstract of Japanese Kokai 05–265307, Oct. 15, 1993.

English Abstract of Japanese Kokai 05–188738, Jul. 30, 1993.

English Abstract of Japanese Kokai 02–272582, Nov. 7, 1990.

*Primary Examiner*—R. L. Moses

*Attorney, Agent, or Firm*—Oblon, Spivak, McClelland, Maier & Neustadt

[57] ABSTRACT

A charge roller rotatable in contact with a photoconductive element in the form of a drum or a belt and applied with a voltage for charging the element, and an image forming apparatus using the same. The surface of the charge roller is ground in order to remove toner particles and other impurities firmly deposited thereon, as needed. The charge roller is capable of uniformly charging the photoconductive element at all times.

24 Claims, 15 Drawing Sheets

CHARGE ROLLER AND IMAGE FORMING APPARATUS USING THE SAME

BACKGROUND OF THE INVENTION

1. Field of the Invention

The present invention relates to a charge roller rotatable in contact with a photoconductive element in the form of a drum or a belt and applied with a voltage for charging the element, and an image forming apparatus using the same.

2. Discussion of the Background

In an electrophotographic image forming apparatus, a corona discharger is a predominant implementation for uniformly charging the surface of an image carrier implemented as a photoconductive element. With a corona discharger, it is possible to charge a photoconductive element to a predetermined potential. However, the problem with a corona discharger is that it needs a high-tension power source and produces ozone when caused to discharge. A great amount of ozone not only pollutes the environment but also causes a charging member and a photoconductive element to deteriorate.

A charge roller is another conventional scheme for uniformly charging the surface of a photoconductive drum. A charge roller is rotatable in contact with a photoconductive drum and is applied with a voltage. A state-of-the-art charge roller, however, is inferior to the corona discharger in respect of uniform charging, although it is operable with a low voltage source and reduces ozone.

To promote uniform charging with a charge roller, an AC voltage whose peak-to-peak voltage is twice as high as a charge start voltage ($V_{TH}$) when a DC voltage is applied may be superposed on the DC voltage, as taught in Japanese Patent Laid-Open Publication No. 63-149668. However, such an AC-biased DC scheme needs an AC power source in addition to a DC power source, increasing the overall cost of the image forming apparatus. Moreover, an AC current, used in a great amount, produces a great amount of ozone, again resulting in the deterioration and environmental pollution problems.

When only a DC voltage is applied to a charge roller, charging becomes irregular since the roller has an elastic layer implemented by a dispersion of synthetic rubber and carbon. Specifically, irregular charging particular to a conventional charge roller stems from electrical irregularity in the elastic carbon/synthetic rubber layer thereof. The irregularity can be eliminated if the elastic layer is implemented by epichlorohydrin rubber having medium resistance. While another issue with the application of only a DC voltage is the withstanding voltage of the roller layer, experiments showed that an elastic layer made of epichlorohydrin rubber noticeably increases the withstanding voltage, compared to the conventional carbon/synthetic rubber mixture. In addition, epichlorohydrin rubber has rubber hardness as high as 40 (prescribed by JIS A) and undergoes hardly any elastic deformation and,therefore, has mechanical strength great enough to enhance the durability of a charge roller.

The AC-biased DC voltage uniformly charges a charge roller due to the superposition of AC even when potentials having formed a latent image or some toner remains on a photoconductive element. However, uniform charging is not attainable with a DC voltage alone unless a charging step begins at the surface of a photoconductive element preliminarily exposed by a quenching lamp, and the charging step begins at the surface of the element from which the residual toner has been fully removed by a cleaning blade, not to speak of unless the charge roller is made of a non-dispersed epichlorohydrin-based elastic substance.

With the conventional carbon/synthetic rubber layer, it is extremely difficult to achieve both of an adequate conductivity (medium resistance) and an adequate withstanding voltage, although such a layer allows the apparent electric resistance to be adjusted on the basis of the content of carbon. Moreover, this kind of elastic layer, in a microscopic view, has electric resistance noticeably differing from carbon portions to synthetic rubber portion, resulting in non-uniform charging and low withstanding voltage. In contrast, when the elastic layer is implemented by epichlorohydrin rubber, which itself has medium resistance ($10^7$ Ωcm to $10^{10}$ Ωcm), not containing carbon or similar conductive particles, the problems attributable to the electric characteristic of the charge roller can be eliminated.

However, even though a charge roller may have desirable electrical and mechanical characteristics stated above and can uniformly charge a photoconductive element only with a DC voltage, it lacks sufficient durability as a charger when incorporated in a particular kind of copier, e.g., high speed copier. When a photoconductive element built in a high speed copier fails to have the surface thereof fully cleaned, a small amount of toner remains on the element even after a cleaning step. This part of toner is transferred to the charge roller which is rotating in contact with the photoconductive element, thereby degrading the charging ability of the charge roller.

While some different approaches have been proposed for cleaning a charge roller, in practice it is extremely difficult to remove a toner and other impurities automatically and completely from the surface of a charge roller. Therefore, with a cleaning device only, it is impracticable to fully clean the surface of a highly durable charge roller, i.e., to maintain the charging ability of the roller constant.

SUMMARY OF THE INVENTION

It is, therefore, an object of the present invention to provide a charge roller capable of maintaining a constant charging ability by having the surface thereof ground, and an image forming apparatus using the same.

In accordance with the present invention, an image forming apparatus having a photoconductive element comprises a charger roller for charging the photoconductive element, and a cleaner having a hardness higher than a predetermined hardness for removing a toner and other impurities deposited on the surface of the charge roller.

Also, in accordance with the present invention, an image forming apparatus having a photoconductive element comprises a charge roller for charging the photoconductive element, and a grinding device for grinding the surface of the charge roller.

Further, in accordance with the present invention, an image forming apparatus having a photoconductive element comprises a charge roller for charging the photoconductive element only with a DC voltage, a display for displaying various kinds of information, a sensor for sensing a charging condition, and a controller responsive to the output of the sensing means for causing the display to display a time for grinding the charge roller.

Furthermore, in accordance with the present invention, an image forming apparatus having a photoconductive element comprises a charge roller for charging the photoconductive element only with a DC voltage, a display for displaying various kinds of information, a counter for counting sheets used for image formation, and a controller responsive to the output of the counter for causing the display to display a time for grinding the charge roller.

Moreover, in accordance with the present invention, a charge roller for charging a photoconductive element only with a DC voltage comprises a metallic core, and an elastic layer of epichlorohydrin rubber covering the metallic core and having a rubber hardness higher than 40 (JIS A) and an electric resistance of $10^7$ Ωcm to $10^{10}$ Ωcm.

In addition, in accordance with the present invention, a charge roller for charging a photoconductive element only with a DC voltage comprises a metallic core, an elastic layer of epichlorohydrin rubber covering the metallic core, and a surface layer covering the elastic layer and made of a fluorine-contained resin/epichlorohydrin rubber mixture.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 20:
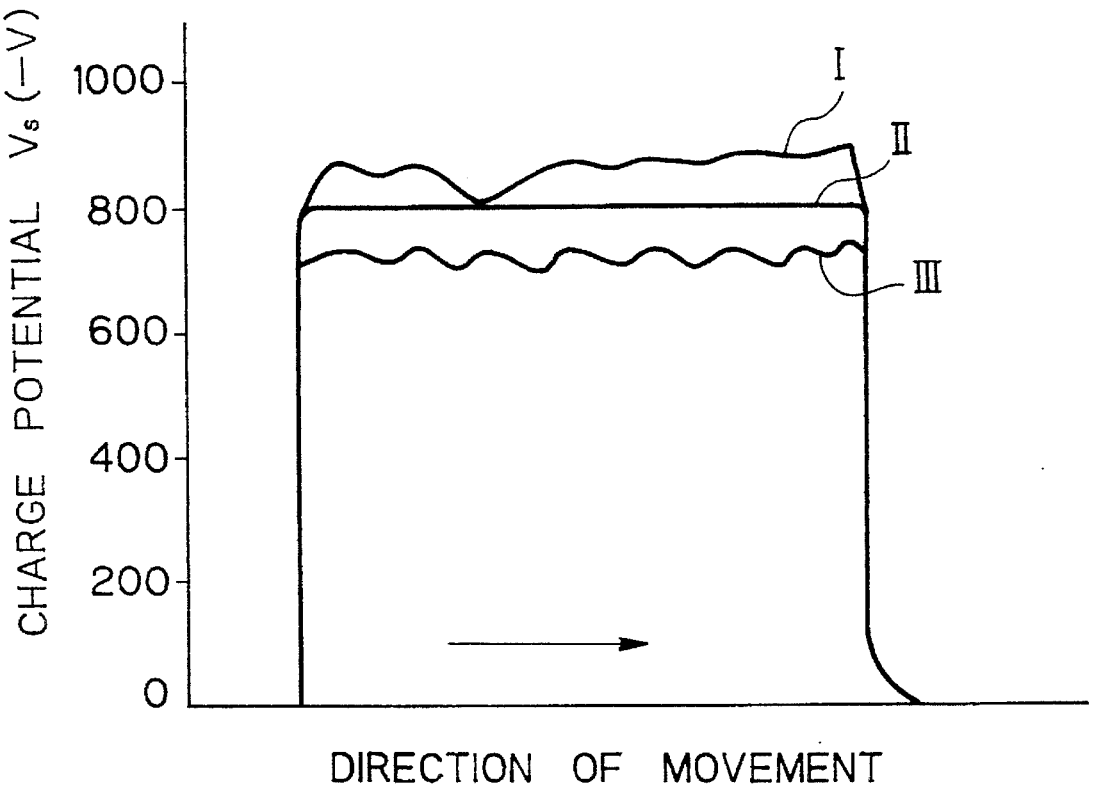
FIG. 20 is a graph indicative of a relation between the charge potential available with a charge roller and the direction of movement.

To better understand the present invention, a reference will be made to FIG. 20 showing a relation between the charge potential derived from an AC-biased DC voltage applied to a charge roller and the direction of movement. As shown, the AC-biased DC voltage uniformly charges a charge roller due to the superposition of AC even when potentials having formed a latent image or some toner remains on a photoconductive element. However, uniform charging is not attainable with a DC bias alone unless the following conditions are satisfied: that the charge roller is made of a non-dispersed epichlorohydrin-based elastic material, that a charging step begins at the surface of a photoconductive element preliminarily exposed by a quenching lamp, and that the charging step begins at the surface of the element from which the residual toner has been fully removed by a cleaning blade. If these conditions are satisfied, a charge roller uniformly charges a photoconductive element, as indicated by a line II in FIG. 20. For comparison, when a quenching lamp is absent, the charge on a photoconductive element is not uniform since the voltage is added to the residual potentials, as indicated by a curve I in FIG. 20. Further, when a photoconductive element is not sufficiently cleaned, the residual toner on the element is transferred to a charge roller with the result that irregular charging occurs at a period particular to the roller, as indicated by a curve III in FIG. 20.

Preferred embodiments of the present invention will be described hereinafter.

[1st Embodiment]

Figure 1:
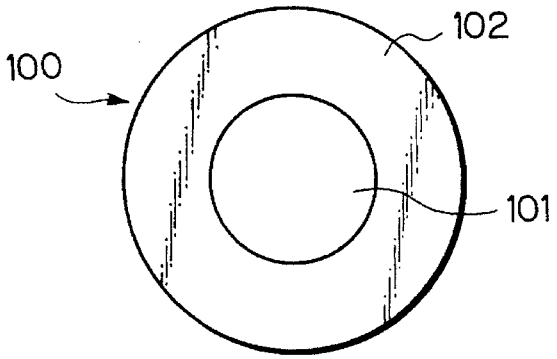
FIG. 1 is a section of a charge roller embodying the present invention.

Referring to FIG. 1, a charge roller 100 embodying the present invention is shown. As shown, the charge roller 100 is made up of a metallic core 101 and an elastic layer 102. The core 101 is made of SUS stainless steel. The elastic layer 102 is implemented by epichlorohydrin rubber and is formed on the core 101 to provide it with an outside diameter of about 16 mm. The elastic layer 102 is mechanically polished to a thickness of 3 mm and a surface roughness of 6 μm at positive points. The charge roller 10 has an electric resistance of $3\times10^8$ Ωcm and a rubber hardness of 40 (prescribed by JIS A).

Figure 2:
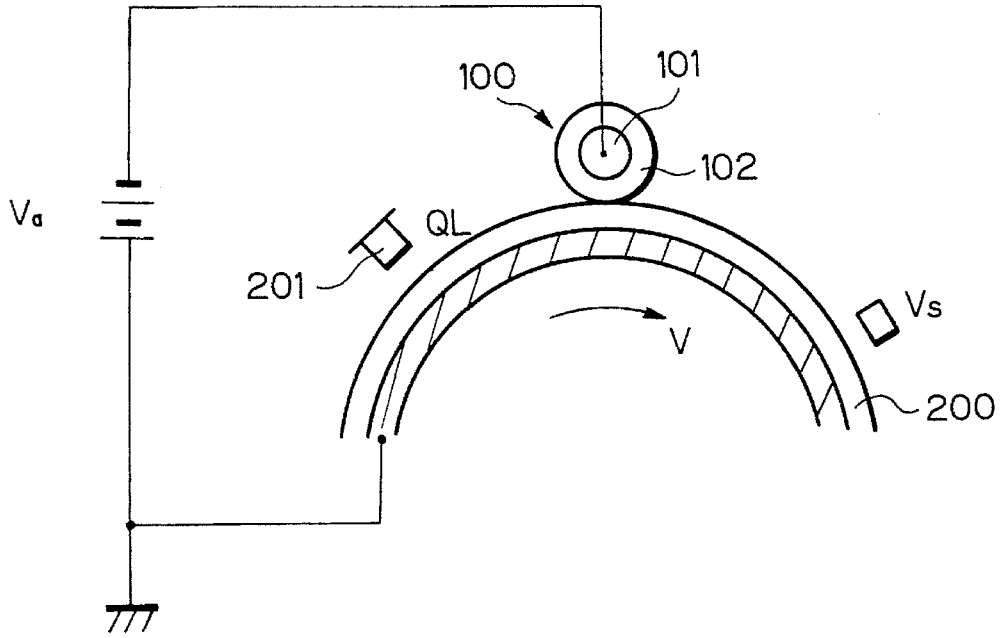
FIG. 2 is a section showing a specific arrangement for testing the durability of the charge roller as to charging characteristic and charging ability.

FIG. 2 shows a specific arrangement for testing the durability of the charge roller 100 as to charging characteristic and charging ability. A photoconductive element in the form of a drum 200 is provided with a 28 μm thick photoconductive layer and driven at a linear velocity V of 120 mm/sec. The roller 100 is held in contact with and driven by the drum 200. After the surface of the drum 200 has been illuminated by light QL from a quenching lamp 201, it is uniformly charged to a potential Vs by a DC voltage Va applied to the roller 100. When the DC voltage Va was −1.5 kV, the roller 100 uniformly charged the drum 200 to a potential Vs ranging from −800 V to −820 V. Regarding durability as to charging ability, the drum 200 is repeatedly charged and optically discharged a number of times corresponding to 30,000 sheets of Z4 size; the durability is evaluated based on the characteristic of the roller 100 and the charge potential deposited on the drum 200 before and after the charging and discharging. After the durability test (30,000 sheets), the roller 100 was found to have a mean surface roughness Rz of 5.5 μm at positive points, electric resistance of $1.5\times10^8$ Ωcm. and rubber hardness of 41 (JIS A). Also, the charging characteristic was found to be Va=−780 V to −810 V, not noticeably different from the characteristic before the test. It will, therefore, be seen that the charging ability of the roller 100 withstands more than 30,000 image forming cycles.

Figure 3:
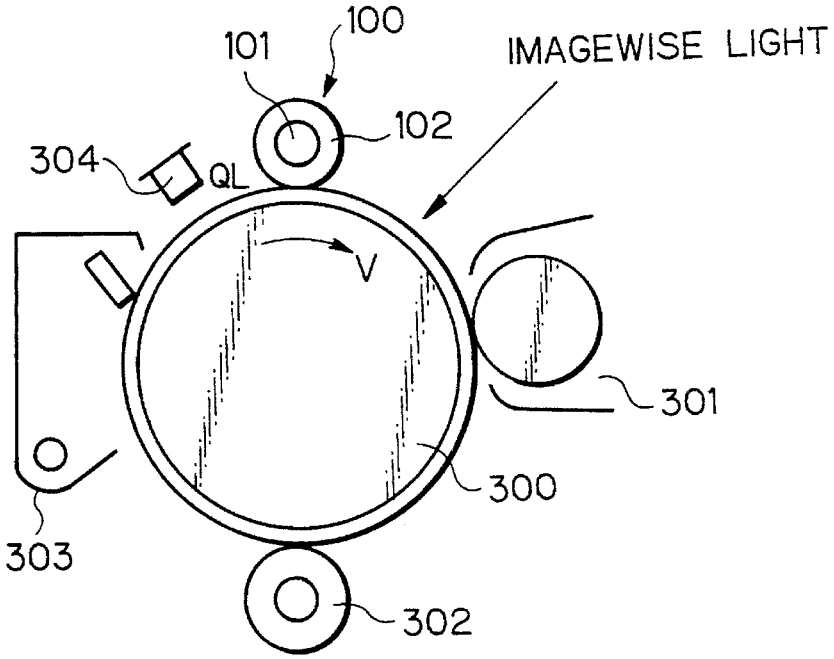
FIG. 3 is a section showing an image forming apparatus loaded with the charge roller and implemented as a laser printer by way of example.

FIG. 3 shows a conventional image forming apparatus implemented as a laser printer by way of example and loaded with the charge roller 100 shown in FIG. 1. As shown, a photoconductive drum 300 has a diameter of 40 mm and has a 28 μm thick photoconductive layer. Arranged around the drum 300 are a developing unit 301, a transfer roller 302, a cleaning unit 303 and a quenching lamp 304 in addition to the charge roller 100. When the drum 300 was rotated at a linear velocity of 60 mm/sec, the charge roller 100 was contaminated little up to the 30,000th image forming cycle to allow clear-cut images with clean backgrounds to be produced. At the 50,000th image forming cycle, two thin stripes appeared on the background of an image. At the 60,000th image forming cycle, conspicuous black stripes appeared together with thin stripes on the background. Then, the operation of the printer was interrupted to remove the roller 100. The surface of the roller 100 was found to have been entirely contaminated by a toner in stripes. Specifically, charging ability is lowered at the portions of the roller 100 where the toner is firmly adhered, resulting in background contamination.

To recover the charging ability of the roller 100, the toner and other impurities deposited thereon have to be removed. The best way of removing the impurities is to grind the surface of the roller 100 to expose a new rubber surface. For this purpose, the roller 100, which had undergone 60,000 image forming cycles, had the surface thereof ground away by 0.05 mm to 0.3 mm in the thicknesswise direction until it obtained a surface roughness Rz of 4 μm to 8 μm at positive points. As a result, the roller 100 fully regained the original characteristic thereof.

An electric resistance of $10^7$ Ωcm to $10^{10}$ Ωcm and rubber hardness higher than 40 (JIS A) are particular to epichlorohydrin rubber and extremely stable. However, when this kind of rubber is applied to a charge roller, the surface of the roller deteriorates due to a toner deposited thereon, reducing the life of the roller. Since epichlorohydrin rubber has rubber hardness feasible for grinding, a single charge roller can be used a plurality of times only if the deteriorated surface thereof is ground away.

The charging ability does not change so long as the surface roughness Rz of a charge roller lies in a range as broad as from 3 μm to 10 μm. A surface roughness Rz lower than 3 μm would increase the grinding cost while a surface roughness Rz higher than 10 μm would aggravate the contamination of the roller surface. However, it is noteworthy that epichlorohydrin rubber has a medium resistance and, therefore, does not cause breakdown at projections higher than 10 μm particular to a carbon-dispersed conductive rubber roller. As to the core, chemically plated iron is not desirable since it gathers rust after a long time of use. A core made of SUS stainless steel is desirable since it is usable repeatedly over a long time, although it increases the cost a little.

[2nd Embodiment]

Figure 4:
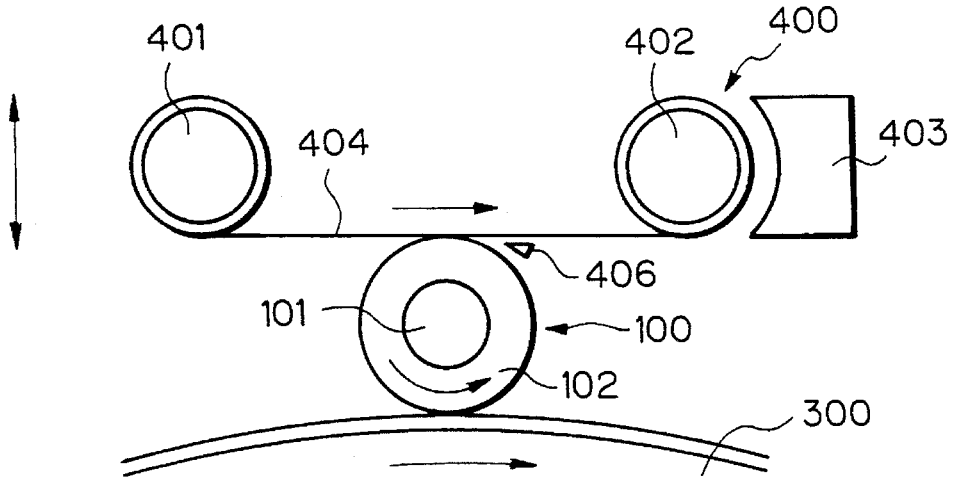
FIG. 4 is a section of a grinding device for grinding the surface of the charge roller.

Referring to FIG. 4, there is shown a grinding device 400 for grinding the surface of the charge roller 100 included in the first embodiment. As shown, the grinding device 400 has a feed roller 401, an abrasive paper 404, a take-up roller 402 driven by a motor 403 for taking up a sand paper or similar abrasive paper 404 paid out from the feed roller 401, and moving means, not shown, for moving the abrasive paper 404 into and out of contact with the roller 100. Implemented by, for example, a spring and an actuator (405 to be described later), the moving means usually holds the abrasive paper 404 apart from the roller 100 due to the force of the spring. When the roller 100 should be ground, the moving means causes the actuator to bring the abrasive paper 404 into contact with the roller 100 against the action of the spring.

Even when the abrasive paper 404 is held stationary, it can grind the roller 100 due to the rotation of the roller 100. However, the stationary abrasive paper 404 would cause the resulting dust 406 to stand around the charge roller 100. In light of this, in the illustrative embodiment, the take-up roller 402 is driven by the motor 304 to move the abrasive paper 404 at low speed in the direction opposite to the direction in which the roller 100 rotates. Hence, the abrasive paper 404 is conveyed while carrying the dust 406 therewith. This allows the dust 406 to be dealt with without effecting the operation of the image forming apparatus in which the grinding device 400 is incorporated. For experiment, the abrasive paper 404 was implemented by Corandom CC-1000 available from Riken (Japan). When such an abrasive paper 404 ground the surface of the charge roller 100, which had undergone 50,000 image forming cycles, for 1 minute over 10 cm, the roller 100 regained a surface as fresh as that of a new roller.

[3rd Embodiment]

Figure 5:
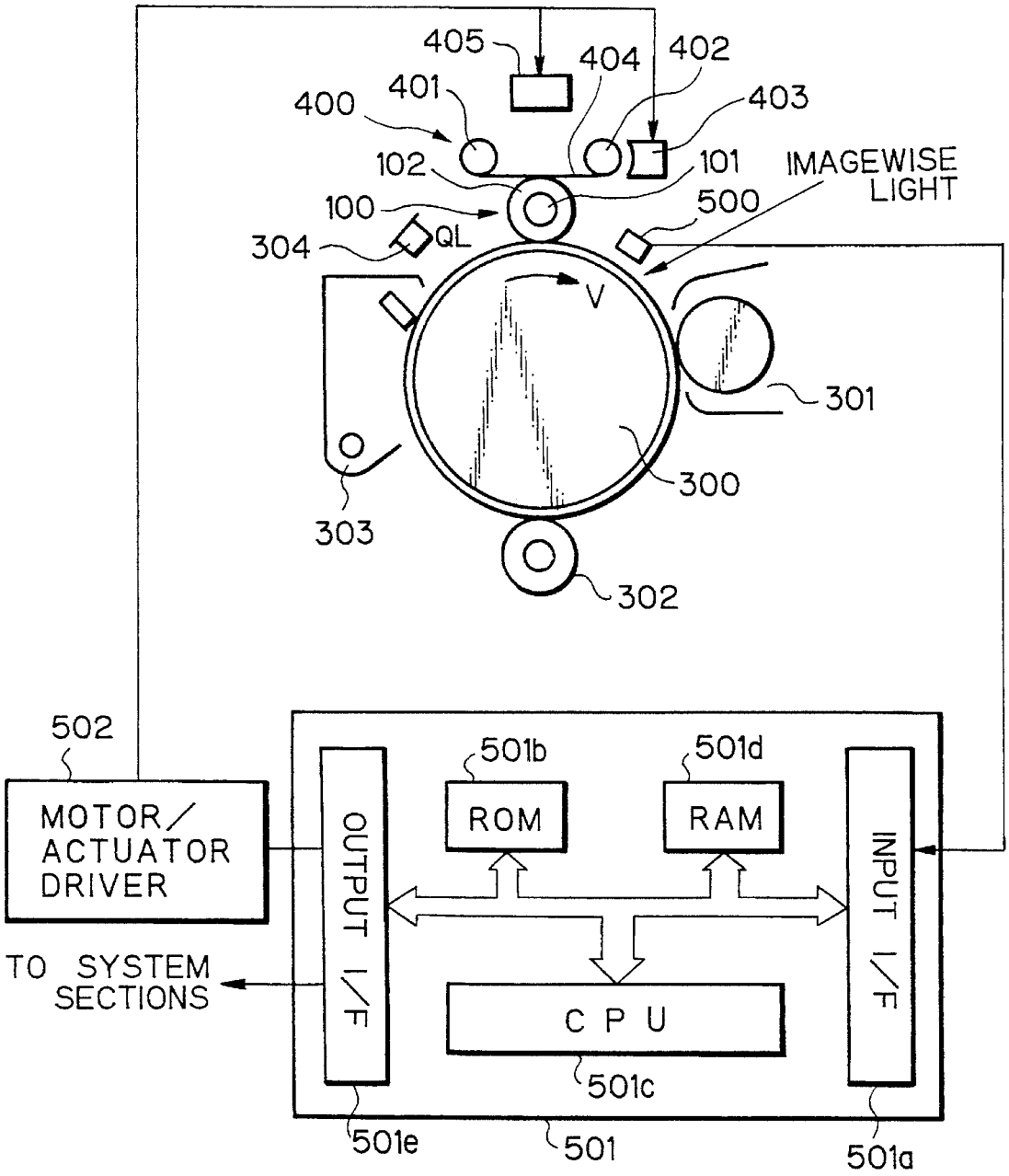
FIG. 5 shows a specific system construction of the laser printer using the charge roller.

FIG. 5 shows the system construction of the laser printer of the illustrative embodiment. As shown, a potential sensor 500 is responsive to a charge deposited on the drum 300 by the charge roller 100. A microcomputer or similar controller 501 performs a predetermined arithmetic operation in response to the output of the potential sensor 500. A motor and actuator driver 502 drives a motor 403 and an actuator 405. Specifically, the controller 501 includes an input interface (I/F) 501*a* for receiving the output of the potential sensor 500 and transferring it to a data bus. A ROM (Read Only Memory) 501*b* stores a program for the control over the various sections of the printer. A CPU (Central Processing Unit) 501*c* executes various kinds of processing according to the program stored in the ROM 501*b*. A RAM (Random Access Memory) 501*d* is available for storing the results of processing of the CPU 501 as well as data. An output I/F 501*e* outputs control commands meant for the outside, including the motor/actuator driver 502, in a predetermined format.

Figure 6:
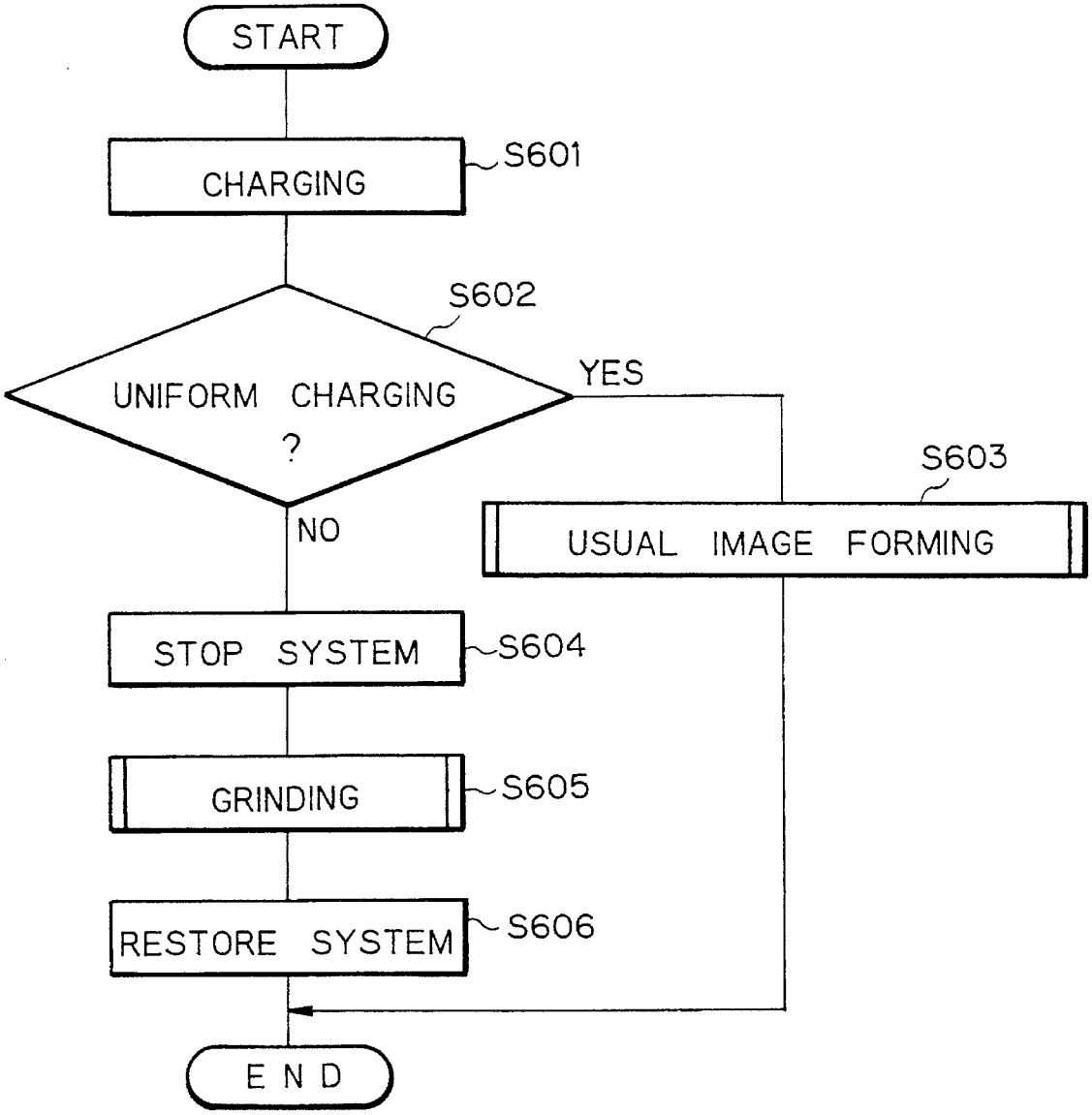
FIG. 6 is a flowchart representing the operation of the laser printer shown in FIG. 5.

The operation of the controller 501 will be described with reference to FIG. 6. As shown, after the charge roller 100 has charged the drum 300 (step S601), the controller 501 determines, based on the resulting output of the potential sensor 500, whether or not the charge on the drum 300 is uniform (step S602). If the charge is uniform (YES, step S602), the controller 501 executes a usual image forming routine (step S603). If otherwise, (NO, step S602), the controller 501 stops the operation of the entire printer (step S604) and then grinds the charge roller 100 (step S605).

The grinding procedure will be described more specifically. When the charge deposited on the drum 300 is irregular, as determined in the step S602 of FIG. 6, the controller 501 sends control signals to the various sections of the system in order to render the system inoperative. Subsequently, the controller 501 delivers a control signal to the motor/actuator driver 502. In response, the motor/actuator driver 502 drives an actuator 405. The actuator 405 moves the grinding device 400 toward the charge roller 100 against the action of the spring until the abrasive paper 404 presses itself against the roller 100. Thereafter, the motor/actuator driver 502 drives the motor 403 so as to rotate the take-up roller 402. Consequently, the abrasive paper 404 is moved at low speed in the direction opposite to the direction in which the roller 100 rotates.

In the above condition, the abrasive paper 404 grinds the elastic epichlorohydrin rubber layer 102 of the roller 100, thereby cleaning the surface of the roller 100. The dust 406, FIG. 4, produced by the paper 404 is entrained by the paper 404. The paper 404 is taken up by the take-up roller 402 together with the dust 406, preventing the dust 406 from contaminating the surrounding area. After the roller 100 has been fully ground, the controller 501 causes the motor/actuator driver 502 to stop rotating the motor 403 and then causes it to stop energizing the actuator 405. Finally, the controller 501 moves the grinding device 400 away from the roller 100 and restores the system (step S606).

[4th Embodiment]

Figure 7:
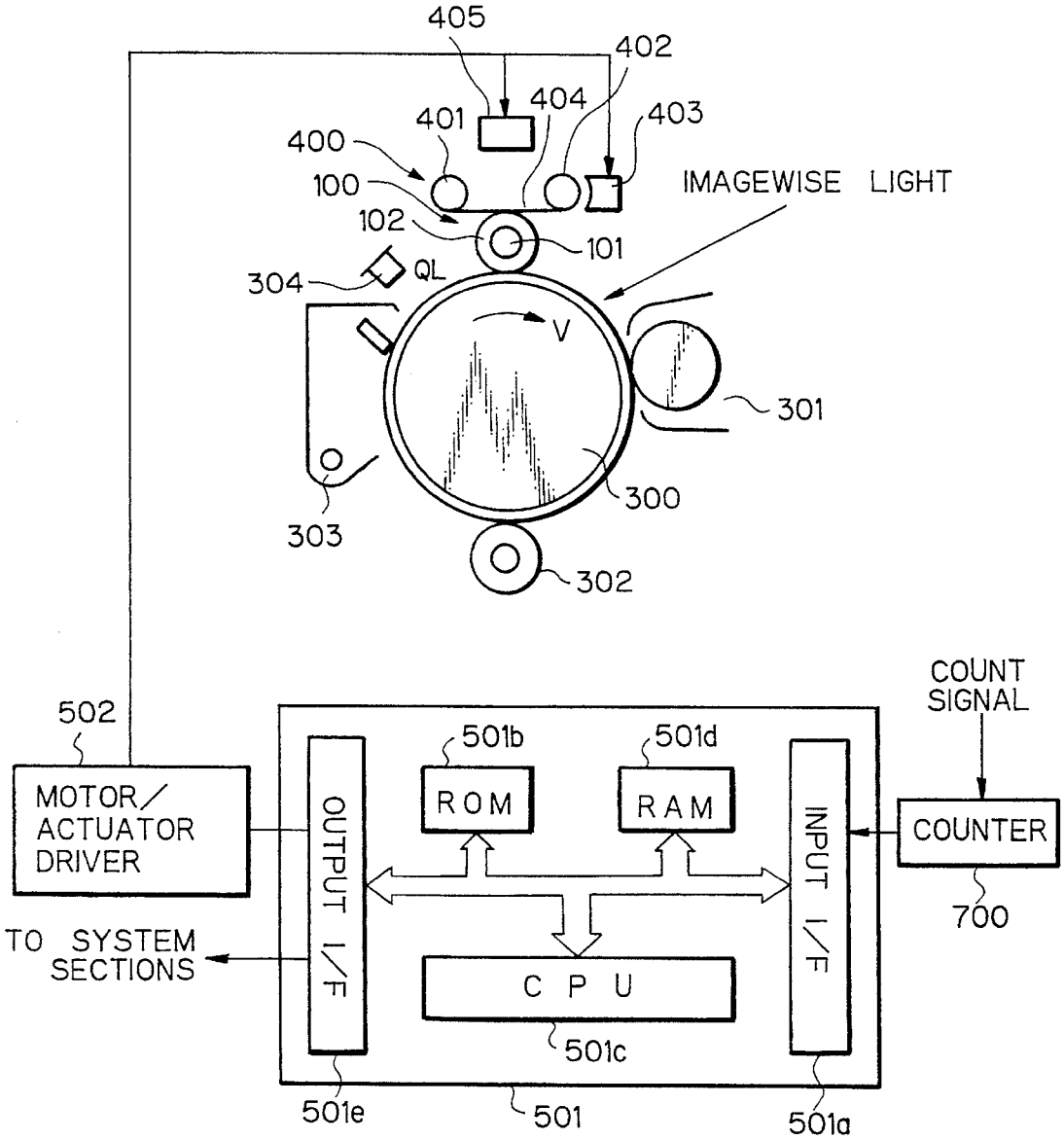
FIG. 7 shows another specific system construction of the laser printer using the charge roller.

FIG. 7 shows another specific system construction of the laser printer of the illustrative embodiment. As shown, this embodiment is essentially similar to the first to third embodiments except for a counter 700 which counts the number of sheets used in the printer. The constituents other than the counter 700 will not be described in order to avoid redundancy.

Figure 8:
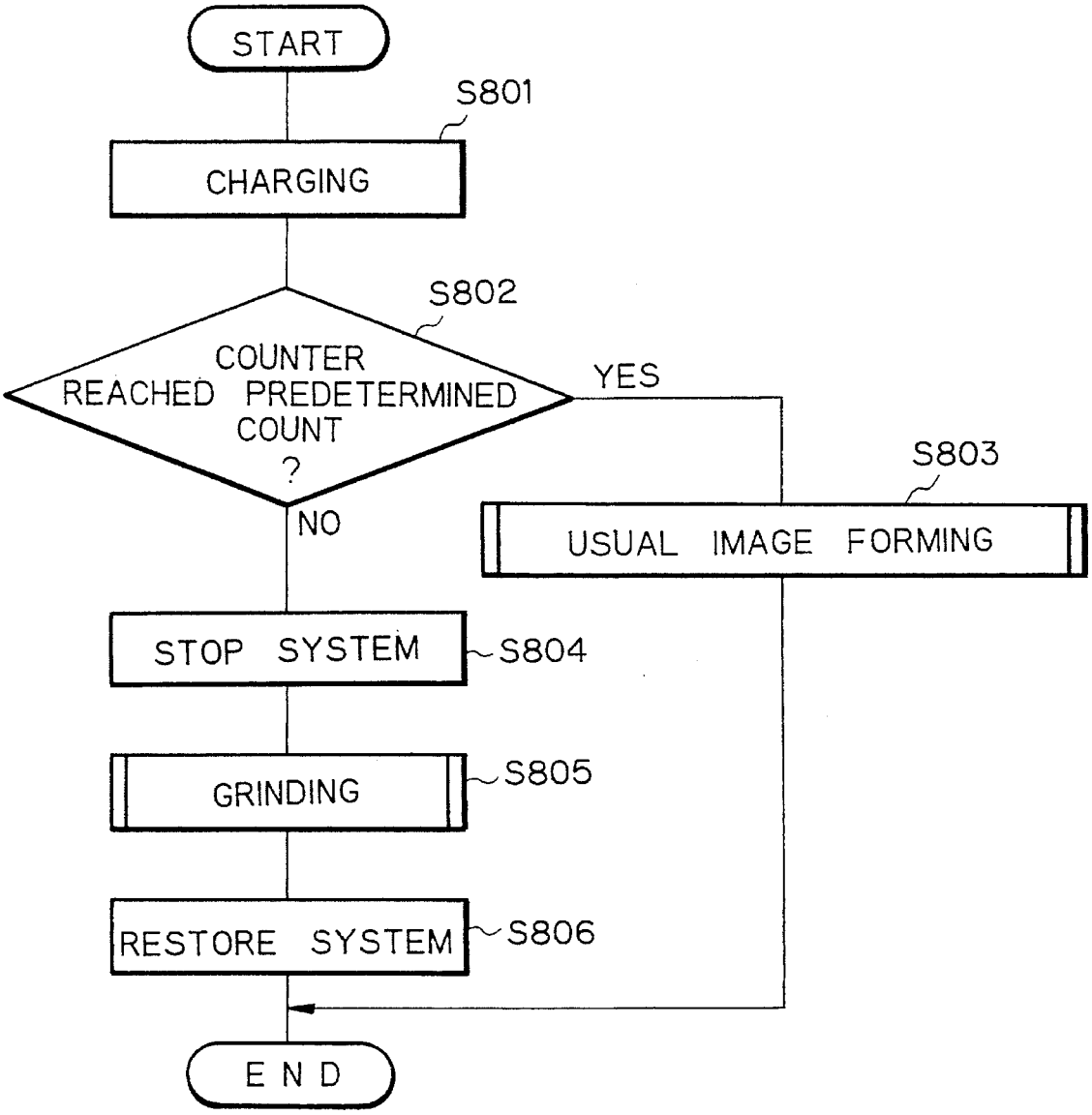
FIG. 8 is a flowchart demonstrating the operation of the laser printer shown in FIG. 7.

The operation of the controller 501 will be described with reference to FIG. 8. As shown, after the charge roller 100 has charged the drum 300 (step S801), the controller 501 determines whether or not the counter 700 has counted a predetermined number of sheets (step S802). If the counter 700 has not counted such a number of sheets (NO, step S802), the controller 501 executes a usual image forming routine (step S803). If otherwise, (YES, step S802), the controller 501 renders the system of the entire printer inoperative (step S804) and then executes a grinding procedure (step S805).

Specifically, on determining that the counter 700 has counted a predetermined number of sheets, the controller 501 sends control signals to the various sections of the system for thereby interrupting the system operation. Subsequently, the controller 501 delivers a control signal to the motor/actuator driver 502. In response, the motor/actuator driver 502 drives the actuator 405. The actuator 405 moves the grinding device 400 toward the charge roller 100 against the action of the spring until the abrasive paper 404 presses itself against the roller 100. Thereafter, the motor/actuator driver 502 drives the motor 403 so as to rotate the take-up roller 402. Consequently, the abrasive paper 404 is moved at low speed in the direction opposite to the direction in which the roller 100 rotates.

In the above condition, the abrasive paper 404 grinds the elastic epichlorohydrin rubber layer 102 of the charge roller 100, thereby cleaning the surface of the roller 100. The dust 406, FIG. 4, produced by the paper 404 is entrained by the paper 404. The paper 404 is taken up by the take-up roller 402 together with the dust 406, preventing the dust 406 from contaminating the surrounding area. After the roller 100 has been fully ground, the controller 501 causes the motor/actuator driver 502 to stop rotating the motor 403 and then causes it to stop energizing the actuator 405. Finally, the controller 501 moves the grinding device 400 away from the roller 100 and restores the system (step S806).

[5th Embodiment]

Figure 9:
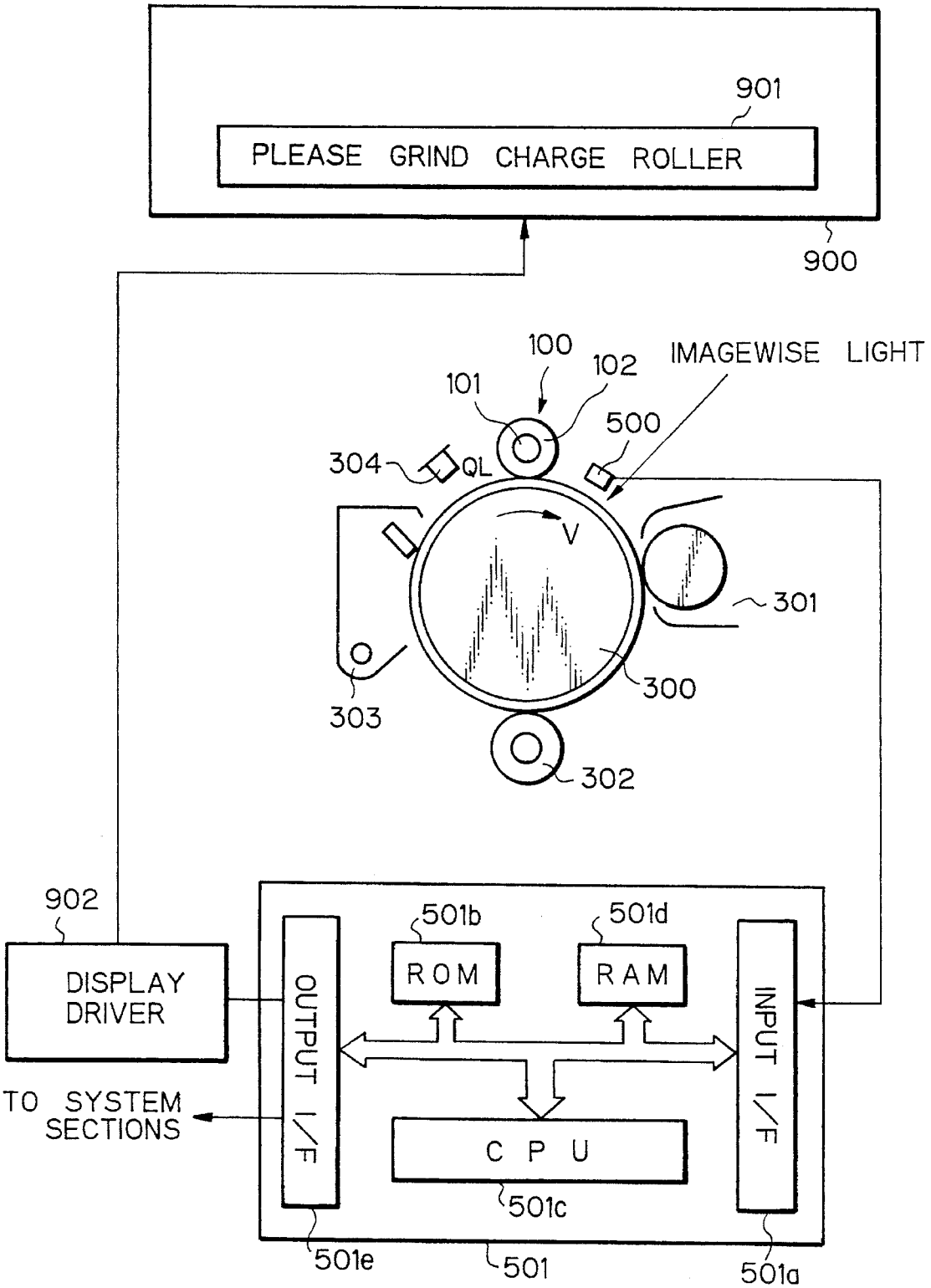
FIG. 9 shows another specific system construction of the laser printer using the charge roller.

FIG. 9 shows another specific system construction of the laser printer of the illustrative embodiment. As shown, this embodiment is essentially similar to the first to third embodiments except for an operation and display panel 900, a display 901 included in the panel 900, and a panel driver 902. The operation and display panel 900 is provided on the printer and driven by the panel driver 902. The other constituents will not be described in order to avoid redundancy.

Figure 10:
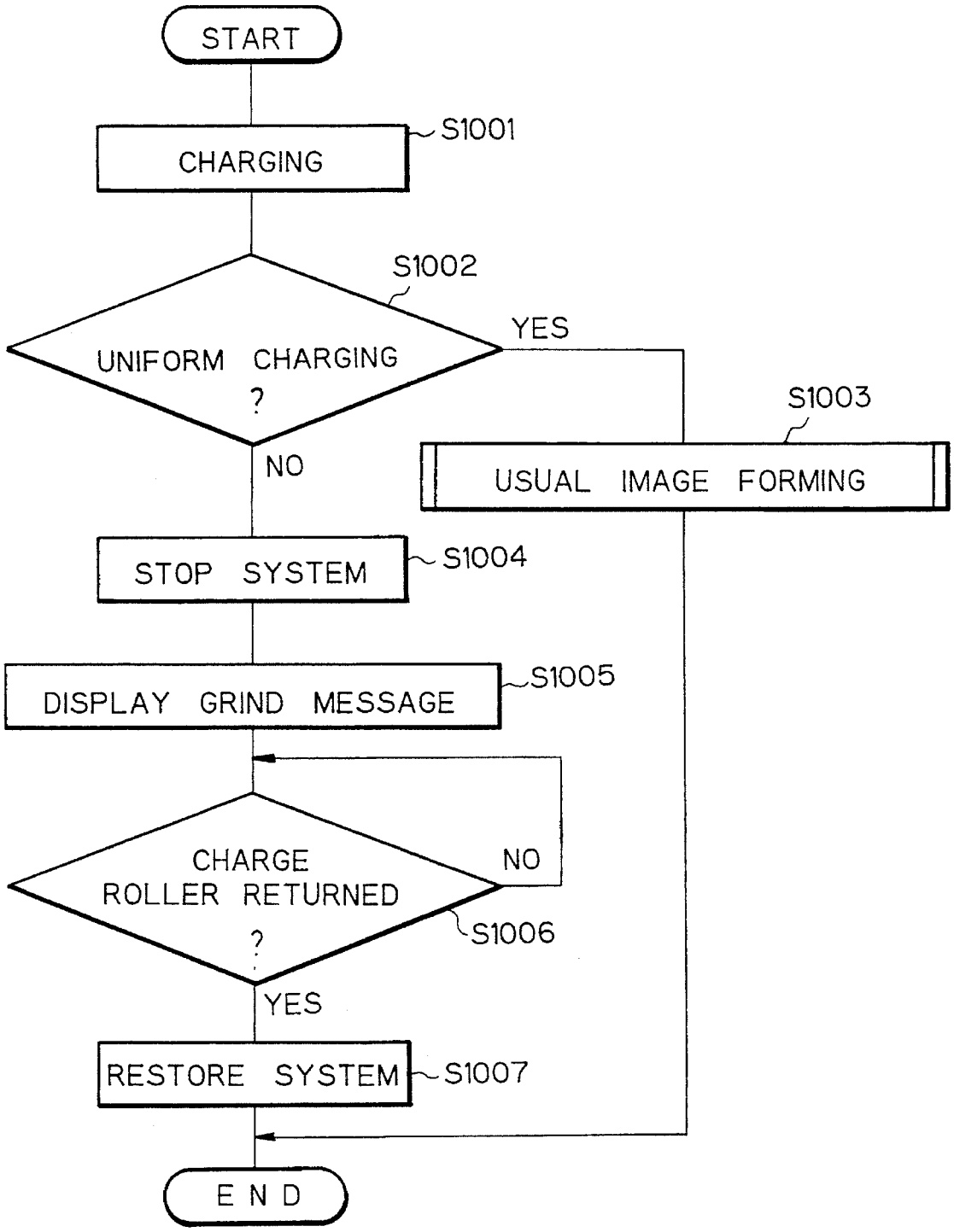
FIG. 10 is a flowchart showing the operation of the laser printer shown in FIG. 9.

The operation of the controller 501 will be described with reference to FIG. 10. As shown, after the charge roller 100 has charged the drum 300 (step S1001), the controller 501 determines whether or not the charge deposited on the drum 300 is uniform in response to the resulting output of the potential sensor 500 (step S1002). If the charge on the drum 300 is uniform (YES, step S1002), the controller 501 executes a usual image forming routine (step S1003). If otherwise, (NO, step S1002), the controller 501 renders the system of the entire printer inoperative (step S1004). Subsequently, the controller 501 sends a control signal to the panel driver 902. In response, the panel driver 902 displays a message urging the operator to grind the roller 100 on the display 901 (step S1005). A specific message "Please grind charge roller" is shown in FIG. 9. Watching the message, the operator removes, for example, the charge roller 100 from the printer, grinds the surface of the roller 100 by a grinding device, not shown, and then mounts the roller 100 to the printer. Thereafter, the controller 501 determines whether or not the roller 100 has been returned to the printer (step S1006) and, if the answer is positive, restores the system (step S1007).

[6th Embodiment]

Figure 11:
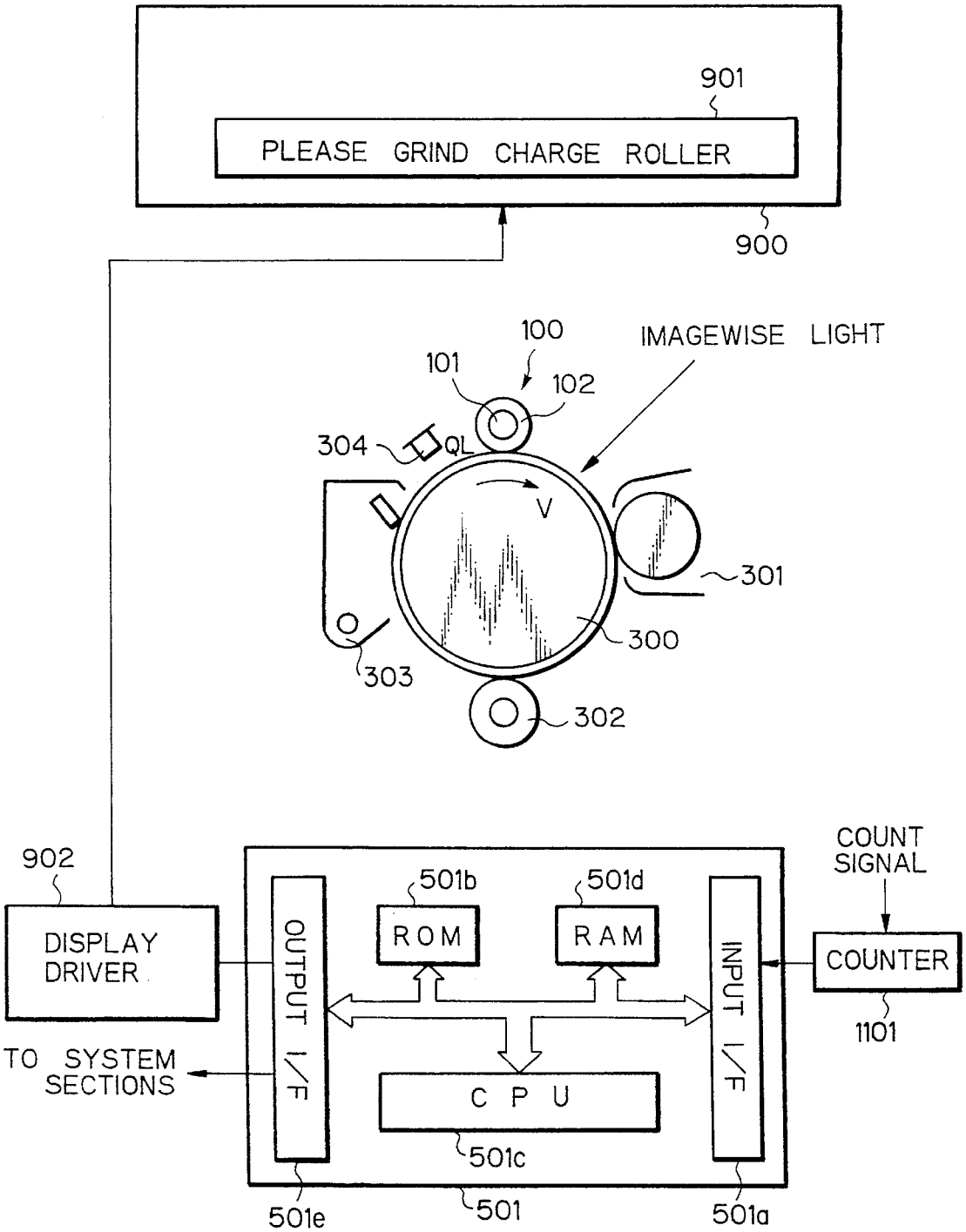
FIG. 11 shows another specific system construction of the laser printer using the charge roller.
Figure 12:
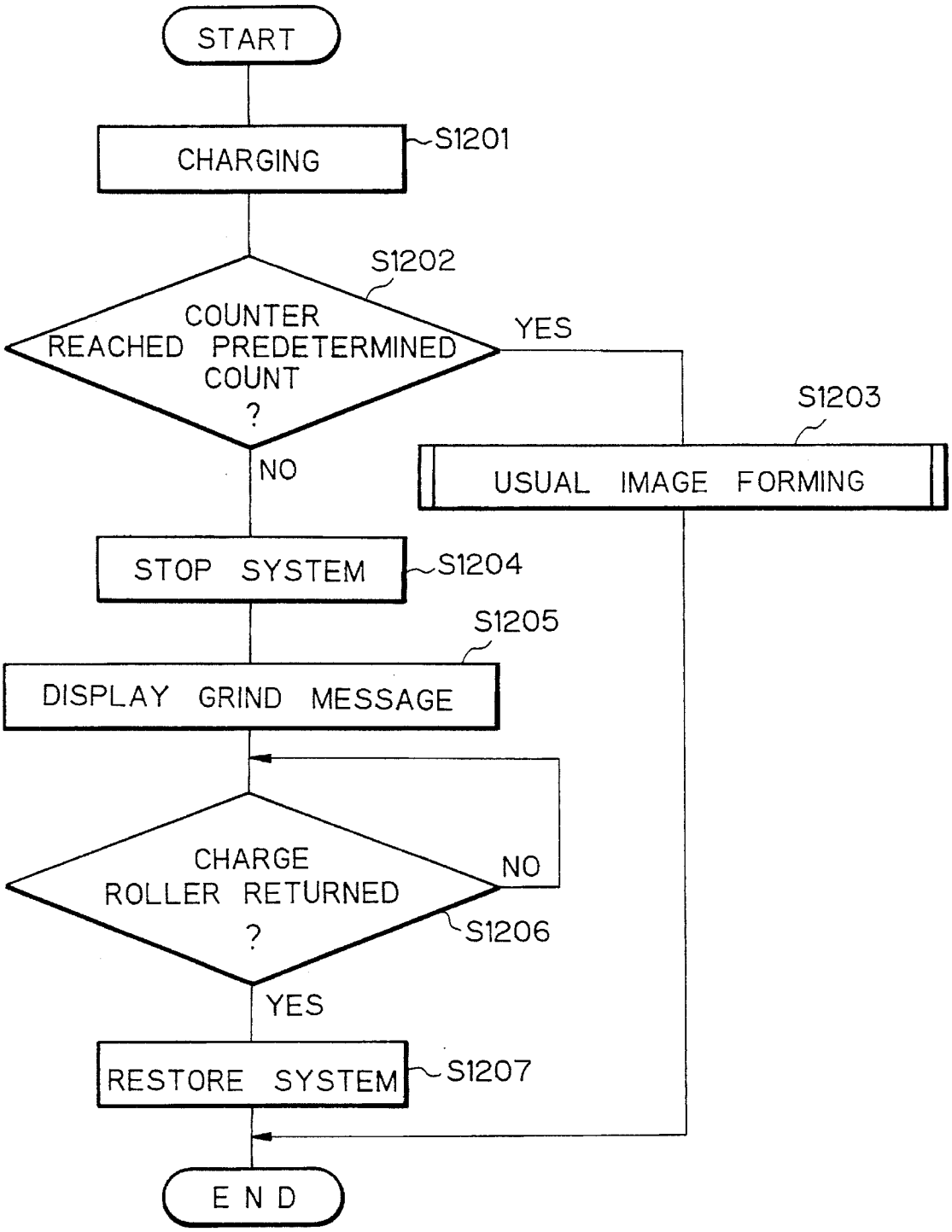
FIG. 12 is a flowchart demonstrating the operation of the laser printer shown in FIG. 11.

FIG. 11 shows another specific system constructions of the laser printer of the illustrative embodiment. As shown, this embodiment is also similar to the foregoing embodiments except for a counter 1101 which counts sheets used in the printer. In operation, as shown in FIG. 12, after the charge roller 100 has charged the drum 300 (step S1201), the controller 501 determines whether or not the counter 1101 has counted a predetermined number of sheets (step S1202). If the counter 1101 has not counted a predetermined number of sheets (NO, step S1202), the controller 501 executes a usual image forming routine (step S1203). If otherwise, (YES, step S1202), the controller 501 renders the system of the entire printer inoperative (step S1204).

Subsequently, the controller 501 sends a control signal to the panel driver 902. In response, the panel driver 902 displays a message urging the operator to grind the charge roller 100 on the display 901 (step S1205). A specific message "Please grind charge roller" is shown in FIG. 11. Watching the message, the operator removes, for example, the charge roller 100 from the printer, grinds the surface of the roller 100 by a grinding device, not shown, and then mounts the roller 100 to the printer. Thereafter, the controller 501 determines whether or not the roller 100 has been returned to the printer (step S1206) and, if the answer is positive, restores the system (step S1207).

[7th Embodiment]

Figure 13:
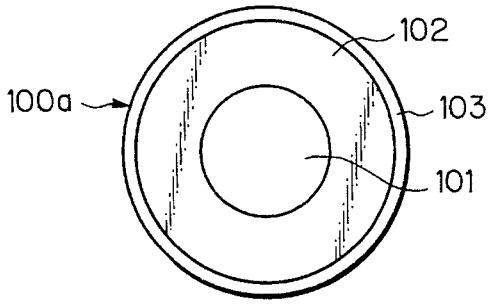
FIG. 13 is a section showing an alternative embodiment of the charge roller in accordance with the present invention.

Referring to FIG. 13, an alternative embodiment of the charge roller in accordance with the present invention is shown. As shown, a charge roller 100*a* has a surface layer 103 in addition to the elastic epichlorohydrin rubber layer 102. Specifically, 100 parts by weight of epichlorohydrin rubber solution (solids: 2.5 wt %), 60 parts by weight of solvent-soluble fluorine-contained resin solution (solids: 108 wt %), and 0.6 part by weight of silica are resolved in toluol and then applied to the rubber layer 102 to form the surface layer 103. The surface layer 103 is 20 μm thick when dried. The roller 100*a* has a surface roughness of 5.5 μm.

Figure 14:
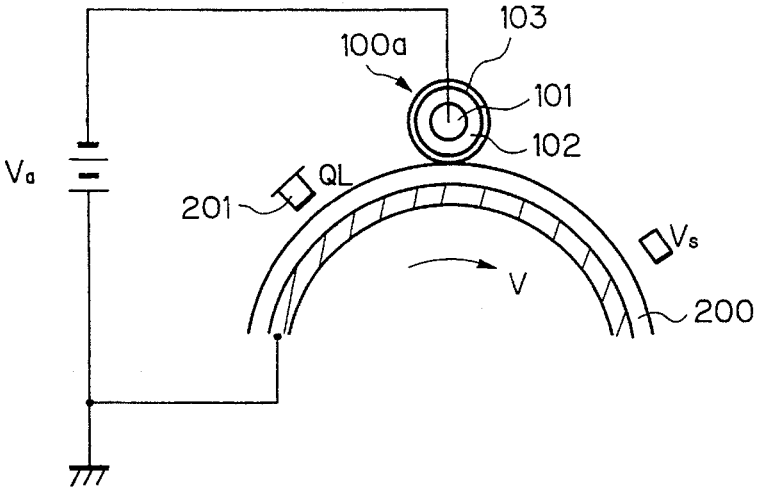
FIG. 14 is a section showing a specific arrangement for testing the durability of the charge roller shown in FIG. 13 as to charging characteristic and charging ability.

FIG. 14 shows a specific arrangement for testing the durability of the charge roller 100*a* as to charging characteristic and charging ability. When the DC bias voltage Va was −1.5 kV, the roller 100*a* uniformly charged a photoconductive drum to a potential Vs ranging from −760 V to −770 V. After a durability test (30,000 image forming cycles), the roller 100*a* was found to have a mean surface roughness Rz of 6 μm at positive points. Also, the charging characteristic was found to be Va=−750 V to −780 V, not noticeably different from the characteristic before the test.

Figure 15:
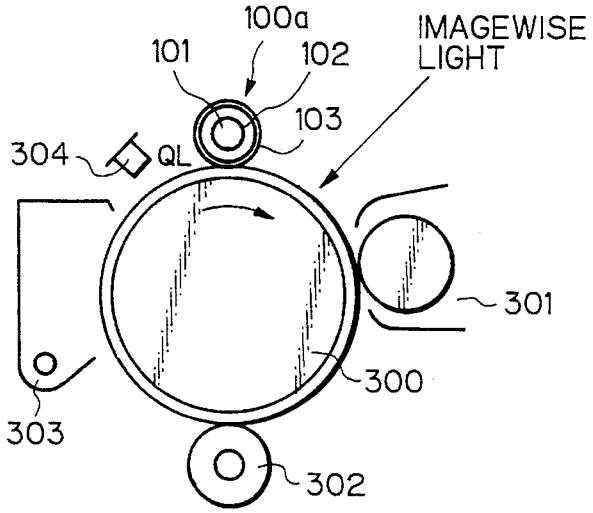
FIG. 15 is a section of a laser printer loaded with the charge roller of FIG. 13.

FIG. 15 shows a conventional laser printer on which the charge roller 100*a*, FIG. 13, is mounted. The charge roller 100*a* was contaminated little up to the 5,000th image forming cycle to allow clear-cut images with clean backgrounds to be produced. At the 8,000th image forming cycle, thin stripes appeared on the background of an image. At the 10,000th copying cycle, conspicuous black stripes appeared together on the background. Then, the operation of the laser printer was interrupted to remove the charge roller 100*a*. The surface of the roller 100 was found to have been entirely contaminated by a toner in stripes. Specifically, charging ability is lowered at the portions of the roller 100*a* where the toner is deposited, resulting in background contamination.

The roller 100*a*, however, is advantageous over the roller 100, FIG. 1, as to toner deposition since it has the surface layer 103 containing non-adhesive resin, i.e., it allows a minimum of toner to deposit thereon. To remove the toner from the roller 100*a*, an abrasive member may advantageously be used.

In FIG. 13, the elastic layer 102 and surface layer 103 bond extremely strongly to each other since both of them contain epichlorohydrin rubber; the bond was evaluated by an X cut tape method (JIS K5400) and gained 8 marks to 10 marks. Moreover, since the surface of the surface layer 103 is resistive to wear, only the toner firmly adhered to the roller 100*a* can be removed if the surface layer 103 is rubbed by a sand paper of fine mesh (#2000 to #3000). In fact, when the surface of the roller 100*a* which has undergone 10,000 image forming cycles was scrubbed several times by a #2000 sand paper, a toner was easily removed.

The surface layer 103 of the charge roller 100*a* has electric an resistance one to two orders higher than that of the elastic layer 102 and has a thickness of 5 μm to 30 μm. Although the surface layer 103 may be thinned during the removal of toner, the charging ability thereof changes little. Even if the surface layer 103, which is 20 μm thick, is entirely ground away, i.e., only the elastic layer 102 is left, the charge potential does not increase more than 40 V to 50 V. The gist is that toner particles and other impurities deposited on a charge roller are the cause of irregular charging, and the best way of removing them is to grind the roller so as to provide it with a level surface.

[8th Embodiment]

Figure 16:
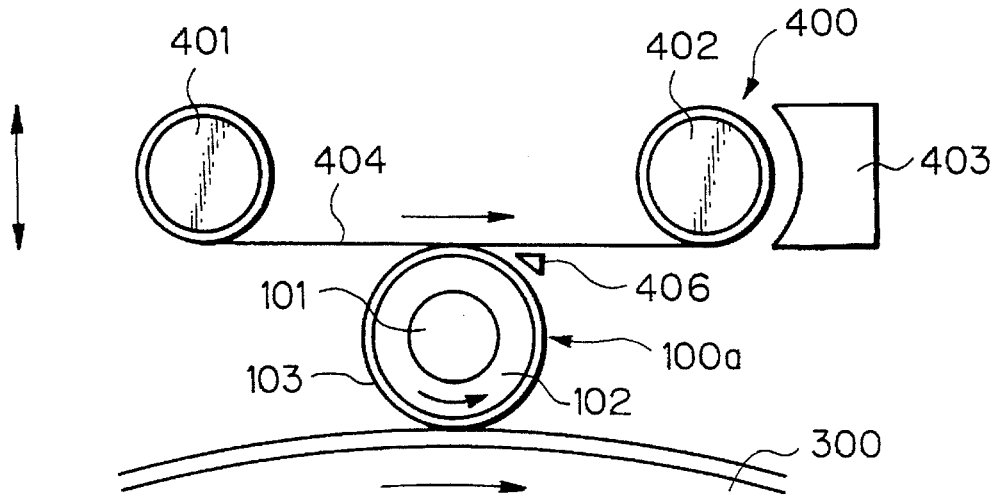
FIG. 16 is a section of a grinding device for grinding the surface of the charge roller shown in FIG. 13.

FIG. 16 shows a grinding device 400 for removing a toner from the surface of the charge roller 100*a*. As shown, the grinding device 400 has a feed roller 401, an abrasive paper 404, a take-up roller 402 driven by a motor 403 for taking up a sand paper or similar abrasive paper 404 paid out from the feed roller 401, and moving means, not shown, for moving the abrasive paper 404 into and out of contact with the charge roller 100*a*. Implemented by, for example, a spring and an actuator (405 to be described later), the moving means usually holds the abrasive paper 404 apart from the charge roller 100*a* due to the force of the spring. When the charge roller 100*a* should be ground, the moving means causes the actuator to bring the abrasive paper 404 into contact with the charge roller 100*a* against the action of the spring.

Figure 17:
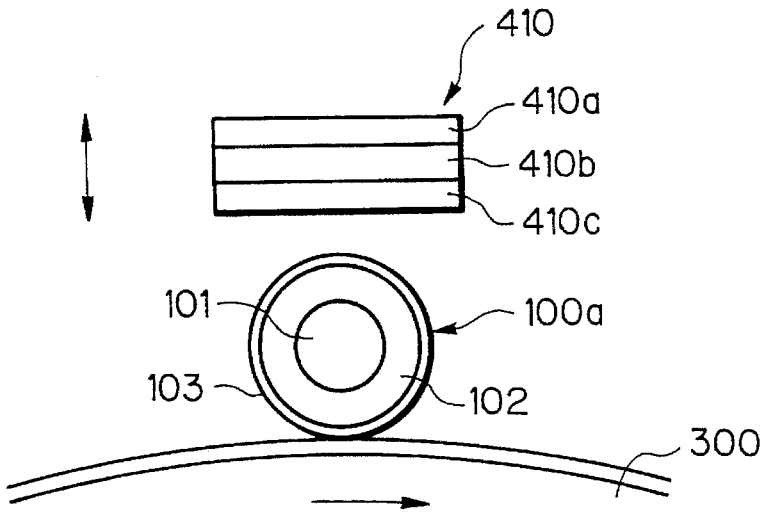
FIG. 17 shows another grinding device applicable to the charge roller shown in FIG. 13.

As for the charge roller 100*a*, all that is required is to remove the toner adhered to the surface layer 103. Even when the abrasive paper 404 is held stationary, it can grind the surface layer 103 due to the rotation of the charge roller 100*a*. Since the amount of dust 406 is small, the feed roller 401, take-up roller 402 and motor 403 may be omitted in order to simplify the grinding device 400. Specifically, as shown in FIG. 17, a grinding device 410 may be used which has only the abrasive paper 404 and the moving means, not shown, for moving it into and out of contact with the charge roller 100*a*. The grinding device 410 has a base 410*a*, an elastic member 410*a* provided on the base 410*a*, and an abrasive paper 410*c* provided on the elastic member 410*b*.

The abrasive paper 404, implemented by Colandom CC-2000 available from Riken (Japan), was found to fully remove a toner from the surface layer 103 of the charge roller 100*a* when the roller 100*a* was rotated only five rotations to ten rotations.

[9th Embodiment]

Figure 18:
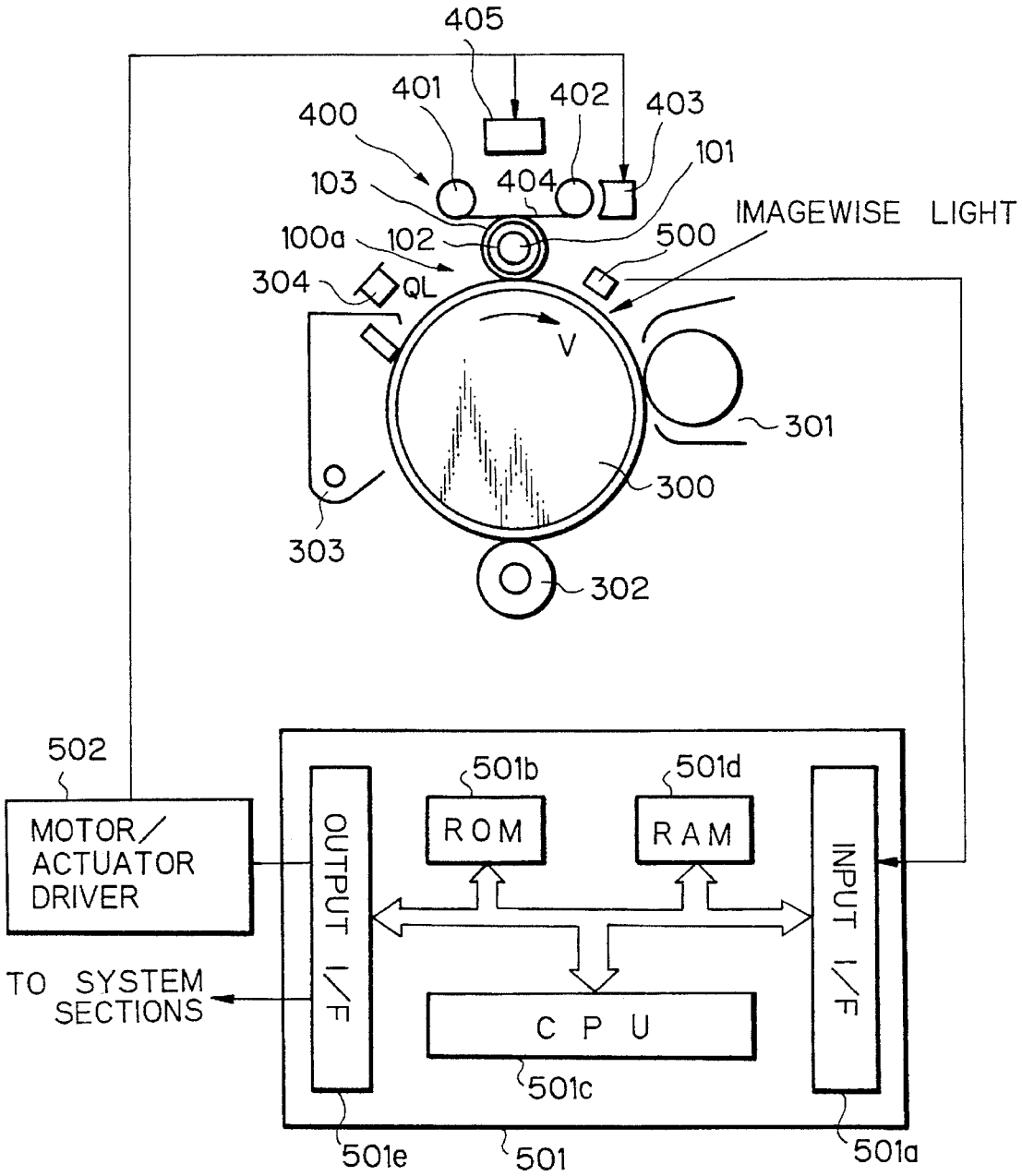
FIG. 18 shows a specific system construction of the laser printer loaded with the charger of FIG. 13.

FIG. 18 shows an image forming system including the charge roller 100*a*. As shown, the system has a potential sensor 500 responsive to a charge deposited on the photoconductive drum 300 by the charge roller 100*a*. On receiving the output of the potential sensor 500, the controller 501 determines whether or not the charge on the drum 300 is uniform. If it is uniform, the controller 501 sends control signals to the various sections of the system to thereby render the system inoperative. Subsequently, the abrasive paper 404 is brought into contact with the roller 100*a* and caused to grind the surface layer 103, thereby removing a toner from the surface layer 103.

[10th Embodiment]

Figure 19:
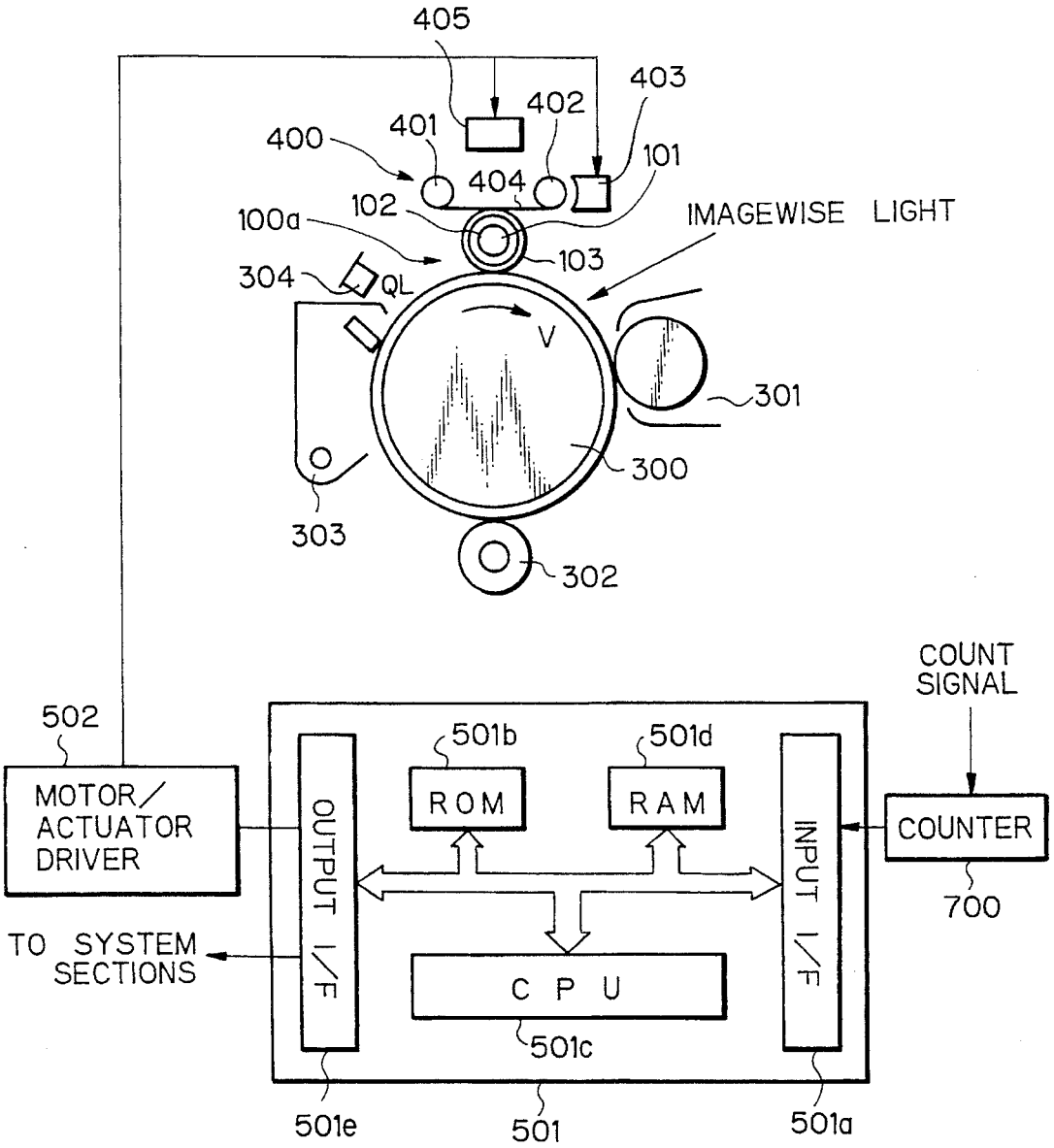
FIG. 19 shows another system construction of the laser printer using the charger of FIG. 13.

FIG. 19 shows another specific system configuration including the charge roller 100*a*. As shown, the system has a counter 700 for counting the number of sheets used in the image forming apparatus. In response to the output of the counter 700, the controller 501 determines whether or not an image forming cycle has been effected with a predetermined number of sheets. If the answer of this decision is positive, the controller 501 sends control signals to the various sections of the system, thereby rendering the system inoperative. Subsequently, the abrasive paper 404 is brought into contact with the roller 100*a* and caused to grind the surface layer 103, thereby removing a toner from the surface layer 103.

In all the embodiments shown and described, the toner in question is a toner which consists of resin and carbon (particle size ranging from 7 μm to 12 μm)and firmly adheres to the roller surface due to the pressure acting between the roller surface and the photoconductive drum as well as to aging. The best way of removing such a toner from the roller surface is to rub it away by use of an abrasive paper, as in the embodiments.

A preferable relation between the toner deposited on the charge roller and the surface layer and elastic layer of the roller as to material, hardness and particle size is shown in Table below.

TABLE

| | Material | Hardness | Particle Size |
|---|---|---|---|
| Abrasive Paper | artificial abrasive | max hardness | Abrasive Grain Sizes JIS R 6001 |
| JIS R 6252 | AA (alumina) | | # 240 50 μm |
| | CC (silicon carbide) natural abrasive | | # 500 28 μm |
| | E (emery) natural abrasive | | # 1000 15.5 μm |
| | G (garnet) natural abrasive | | # 2000 8.5 μm |
| | F (silica) | | # 3000 5.7 μm |
| Deposited Toner | styrene-acryl resin carbon | M75–90 (JIS K 7202) JIS K 7202 Rockwell hardness test | toner particle size 7–12 μm |
| Surface Layer | fluorin-contained resin nylon-contained resin | M60–80 (JIS K 7202) | roller surface roughness 3–10 μm |
| Elastic Layer | EPDM, epichlorohydrin rubber | rubber hardness 30–50 (JIS A) JIS K 6301 rubber hardness test | rubber roller surface roughness 3–10 μm |

In the Table, the deposited toner and the surface layer of the charge roller have hardnesses ranging from M60 to M90 as determined by a Rockwell hardness testing method (JIS K7202) customarily effected with plastics. The elastic layer has a rubber hardness (JIS A) lying in the range of from 30 to 50, as determined by a rubber hardness testing method (JIS K6301).

The embodiments described above have the following advantages. Since the elastic layer is implemented by epichlorohydrin rubber having medium resistance, uniform charging is achievable without resorting to an AC voltage conventionally superposed on a DC voltage. This not only reduces power source cost but also eliminates the ozone problem. The charge roller, made up of the SUS metallic core and single epichlorohydrin rubber layer, is simple in structure and allows the surface thereof to be ground. Hence, the charge roller is reusable and provided with a longer service life. The grinding means disposed in the image forming apparatus makes it needless for the operator to remove the charge roller from the image forming apparatus, grind it, and then return it to the apparatus, thereby promoting an efficient operation. The grinding means disposed in the apparatus is automatically controlled on the basis of a charge deposited on the surface of the photoconductive drum or the number of sheets used in the apparatus. As a result, irregular charging attributable to aging is obviated. Furthermore, the operator is automatically urged to grind the charge roller on the basis of a charge on the surface of the drum or the number of sheets used in the apparatus, also obviating irregular charging attributable to aging.

In summary, in accordance with the present invention, toner particles and other impurities firmly adhered to the surface of a charge roller can be surely removed. This, coupled with the fact that the surface of the charge roller can be surely ground only when required, maintains the charging ability of the charge roller constant at all times. In addition, it is easy to see the time for grinding the charge roller.

Various modifications will become possible for those skilled in the art after receiving the teachings of the present disclosure without departing from the scope thereof.

What is claimed is:

1. An image forming apparatus comprising:

a charger roller for charging said photoconductive element; and a cleaner having a hardness higher than a predetermined hardness for removing a toner and other impurities deposited on a surface of said charge roller, wherein said cleaner comprises an abrasive paper.

2. An image forming apparatus comprising:

a charger roller for charging said photoconductive element; and a cleaner having a hardness higher than a predetermined hardness for removing a toner and other impurities deposited on a surface of said charge roller, wherein said cleaner is higher in hardness than the surface of said charge roller and the toner and other impurities.

3. An image forming apparatus having a photoconductive element, comprising:

a charge roller for charging said photoconductive element; and grinding means for grinding a surface of said charge roller.

4. An apparatus as claimed in claim 3, wherein said charge roller charges said photoconductive element only with a DC voltage.

5. An apparatus as claimed in claim 4, wherein said charge roller comprises a metallic core, and an elastic layer of epichlorohydrin rubber covering said metallic core and having a rubber hardness higher than 40 (JIS A) and an electric resistance of $10^7$–$10^{10}$ Ωcm.

6. An apparatus as claimed in claim 5, wherein said elastic layer has a surface roughness of 3 μm to 10 μm.

7. An apparatus as claimed in claim 6, further comprising:

grinding means for grinding the surface of said charge roller;

sensing means for sensing a charging condition; and control means responsive to an output of said sensing means for causing said grinding means to grind the surface of said charge roller.

8. An apparatus as claimed in claim 7, further comprising display means, said control means causing, in response to the output of said sensing means, said display means to display a time for grinding said charge roller.

9. An apparatus as claimed in claim 6, further comprising:

counting means for counting sheets used for image formation; and control means responsive to an output of said counting means for causing said grinding means to grind the surface of said charge roller.

10. An apparatus as claimed in claim 9, further comprising display means, said control means causing, in response to the output of said counting means, said display means to display a time for grinding said charge roller.

11. An apparatus as claimed in claim 4, wherein said charge roller comprises a metallic core, an elastic layer of epichlorohydrin covering said metallic core, and a layer of fluorine-contained resin/epichlorohydrin rubber mixture covering said elastic layer.

12. An apparatus as claimed in claim 11, wherein said charge roller has a surface roughness of 3 μm to 10 μm.

13. An apparatus as claimed in claim 13, further comprising:

sensing means for sensing a charging condition of said charge roller; and control means for controlling a grinding operation of said grinding means in response to an output of said sensing means.

14. An apparatus as claimed in claim 12, further comprising:

counting means for counting sheets used for image formation; and control means for controlling a grinding operation of said grinding means in response to an output of said counting means.

15. An image forming apparatus having a photoconductive element, comprising:

a charge roller for charging said photoconductive element only with a DC voltage;

display means for displaying various kinds of information;

sensing means for sensing a charging condition; and control means responsive to an output of said sensing means for causing said display means to display a time for grinding said charge roller.

16. An apparatus as claimed in claim 15, wherein said charge roller comprises a metallic core, and an elastic layer of epichlorohydrin rubber covering said metallic core and having a rubber hardness higher than 40 (JIS A) and an electric resistance of $10^7$ μcm to $10^{10}$ μcm.

17. An apparatus as claimed in claim 16, wherein said elastic layer has a surface roughness of 3 μm to 10 μm.

18. An image forming apparatus having a photoconductive element, comprising:

a charge roller for charging said photoconductive element only with a DC voltage;

display means for displaying various kinds of information;

counting means for counting sheets used for image formation; and control means responsive to an output of said counting means for causing said display means to display a time for grinding said charge roller.

19. An apparatus as claimed in claim 18, wherein said charge roller comprises a metallic core, and an elastic layer of epichlorohydrin rubber covering said metallic core and having a rubber hardness of higher than 40 (JIS A) and an electric resistance of $10^7$ μcm to $10^{10}$ μcm.

20. An apparatus as claimed in claim 19, wherein said elastic layer has a surface roughness of 3 μm to 10 μm.

21. A charge roller for charging a photoconductive element only with a DC voltage, comprising:

a metallic core; and an elastic layer of epichlorohydrin rubber covering said metallic core and having a rubber hardness higher than 40 (JIS A) and an electric resistance of $10^7$ Ωcm to $10^{10}$ Ωcm.

22. A charge roller as claimed in claim 21, wherein said elastic layer has a surface roughness of 3 μm to 10 μm.

23. A charge roller for charging a photoconductive element only with a DC voltage, comprising:

a metallic core;

an elastic layer of epichlorohydrin rubber covering said metallic core; and a surface layer covering said elastic layer and made of a fluorine-contained resin/epichlorohydrin rubber mixture.

24. A charge roller as claimed in claim 23, wherein said surface layer has a surface roughness of 3 μm to 10 μm.

* * * * *